US009587470B2

(12) United States Patent
Harris

(10) Patent No.: US 9,587,470 B2
(45) Date of Patent: Mar. 7, 2017

(54) ACOUSTIC ARTIFICIAL LIFT SYSTEM FOR GAS PRODUCTION WELL DELIQUIFICATION

(71) Applicant: Dennis John Harris, Houston, TX (US)

(72) Inventor: Dennis John Harris, Houston, TX (US)

(73) Assignee: CHEVRON U.S.A. INC., San Ramon, CA (US)

( * ) Notice: Subject to any disclaimer, the term of this patent is extended or adjusted under 35 U.S.C. 154(b) by 193 days.

(21) Appl. No.: 13/842,211

(22) Filed: Mar. 15, 2013

(65) Prior Publication Data

US 2014/0262229 A1 Sep. 18, 2014

(51) Int. Cl.
*E21B 43/12* (2006.01)

(52) U.S. Cl.
CPC ..... *E21B 43/121* (2013.01)

(58) Field of Classification Search
CPC ..... E21B 43/12; E21B 43/121
See application file for complete search history.

(56) References Cited

U.S. PATENT DOCUMENTS

| | | | | | |
|---|---|---|---|---|---|
| 2,444,912 | A | * | 7/1948 | Bodine, Jr. | 417/53 |
| 2,700,422 | A | * | 1/1955 | Bodine, Jr. | 166/249 |
| 2,953,095 | A | * | 9/1960 | Bodine | 417/241 |
| 3,303,782 | A | * | 2/1967 | Bodine, Jr. | 417/53 |
| 3,583,677 | A | * | 6/1971 | Phillips | 366/120 |
| 3,648,769 | A | * | 3/1972 | Sawyer | 166/177.2 |
| 3,860,173 | A | | 1/1975 | Sata | |
| 3,990,512 | A | * | 11/1976 | Kuris | 166/249 |
| 4,019,683 | A | | 4/1977 | Asai et al. | |
| 4,085,893 | A | | 4/1978 | Durley, III | |
| 4,153,201 | A | | 5/1979 | Berger | |
| 4,280,557 | A | * | 7/1981 | Bodine | 166/177.2 |
| 4,295,799 | A | * | 10/1981 | Bentley | 417/240 |
| 4,337,896 | A | | 7/1982 | Berger | |
| 4,341,505 | A | * | 7/1982 | Bentley | 417/240 |
| 4,398,870 | A | * | 8/1983 | Bentley | 417/240 |

(Continued)

FOREIGN PATENT DOCUMENTS

| | | | |
|---|---|---|---|
| CN | 1305047 | A | 7/2001 |
| CN | 1112503 | C | 6/2003 |

(Continued)

OTHER PUBLICATIONS

International Search Report, issued on Jul. 17, 2014, during the prosecution of International Application No. PCT/US2014/026293.

(Continued)

*Primary Examiner* — Angela M DiTrani
*Assistant Examiner* — Crystal J Miller

(57) ABSTRACT

An acoustic artificial lift system and method for deliquification of gas production wells is provided. The artificial lift system comprises a down-hole acoustic tool suspended by a power conductive cable that converts electrical power to acoustic energy, thereby generating an acoustic wave. The acoustic tool is moved within the wellbore such that liquid molecules within the wellbore are vaporized by the acoustic wave. Natural gas produced by a producing zone of the subterranean reservoir transports the vaporized liquid molecules to the well surface.

20 Claims, 9 Drawing Sheets

(56) References Cited

U.S. PATENT DOCUMENTS

| | | | | |
|---|---|---|---|---|
| 4,632,311 | A | 12/1986 | Nakane et al. | |
| 4,687,420 | A * | 8/1987 | Bentley | 417/240 |
| 4,747,920 | A | 5/1988 | Muralidhara et al. | |
| 5,184,678 | A * | 2/1993 | Pechkov et al. | 166/249 |
| 5,219,120 | A | 6/1993 | Ehrenberg | |
| 5,370,317 | A | 12/1994 | Weston | |
| 5,595,243 | A * | 1/1997 | Maki et al. | 166/177.2 |
| 5,706,892 | A * | 1/1998 | Aeschbacher et al. | 166/66 |
| 5,753,812 | A * | 5/1998 | Aron et al. | 73/152.47 |
| 5,829,530 | A | 11/1998 | Nolen | |
| 5,994,818 | A * | 11/1999 | Abramov et al. | 310/325 |
| 6,059,040 | A | 5/2000 | Levitan et al. | |
| 6,186,228 | B1 * | 2/2001 | Wegener et al. | 166/249 |
| 6,196,312 | B1 | 3/2001 | Collins | |
| 6,279,653 | B1 * | 8/2001 | Wegener et al. | 166/249 |
| 6,382,321 | B1 | 5/2002 | Bates et al. | |
| 6,405,796 | B1 * | 6/2002 | Meyer et al. | 166/249 |
| 6,429,575 | B1 * | 8/2002 | Abramov et al. | 310/337 |
| 6,619,394 | B2 * | 9/2003 | Soliman et al. | 166/249 |
| 6,830,108 | B2 | 12/2004 | Rogers, Jr. | |
| 7,063,144 | B2 * | 6/2006 | Abramov et al. | 166/249 |
| 7,135,155 | B1 | 11/2006 | Long, Jr. et al. | |
| 7,287,597 | B2 * | 10/2007 | Shaposhnikov et al. | 166/372 |
| 7,422,064 | B1 | 9/2008 | Yang | |
| 7,503,950 | B2 | 3/2009 | Håland | |
| 7,506,690 | B2 | 3/2009 | Kelley | |
| 7,717,182 | B2 | 5/2010 | Butler et al. | |
| 7,784,538 | B2 * | 8/2010 | McCoy et al. | 166/250.03 |
| 7,790,002 | B2 | 9/2010 | Penrose | |
| 8,011,901 | B2 * | 9/2011 | Duncan | 417/390 |
| 8,069,914 | B2 * | 12/2011 | Groves | 166/105 |
| 8,113,278 | B2 | 2/2012 | DeLaCroix et al. | |
| 8,122,962 | B2 | 2/2012 | Croteau | |
| 8,122,966 | B2 | 2/2012 | Kelley | |
| 8,261,834 | B2 | 9/2012 | Eslinger | |
| 8,297,363 | B2 | 10/2012 | Kenworthy et al. | |
| 8,302,695 | B2 | 11/2012 | Simpsonq | |
| 8,316,950 | B2 | 11/2012 | Rodriguez | |
| 8,382,375 | B2 | 2/2013 | Prieto | |
| 8,511,390 | B2 | 8/2013 | Coyle | |
| 8,560,268 | B2 * | 10/2013 | Smithson | 702/166 |
| 8,584,747 | B2 | 11/2013 | Eslinger | |
| 8,613,312 | B2 | 12/2013 | Zolezzi-Garreton | |
| 8,657,940 | B2 | 2/2014 | Aarebrot | |
| 8,746,333 | B2 * | 6/2014 | Zolezzi-Garreton | 166/177.1 |
| 8,931,587 | B2 * | 1/2015 | Chelminski | 181/121 |
| 2003/0042018 | A1 * | 3/2003 | Huh et al. | 166/249 |
| 2004/0216886 | A1 | 11/2004 | Rogers, Jr. | |
| 2005/0022998 | A1 | 2/2005 | Rogers | |
| 2005/0161258 | A1 * | 7/2005 | Lockerd et al. | 175/45 |
| 2005/0252837 | A1 | 11/2005 | Haland | |
| 2006/0054329 | A1 * | 3/2006 | Chisholm | 166/372 |
| 2006/0213652 | A1 | 9/2006 | Shaposhnikov et al. | |
| 2007/0000663 | A1 | 1/2007 | Kelley | |
| 2007/0221383 | A1 | 9/2007 | Mason et al. | |
| 2008/0063544 | A1 * | 3/2008 | Duncan | 417/401 |
| 2008/0080990 | A1 * | 4/2008 | Duncan | 417/390 |
| 2008/0105426 | A1 * | 5/2008 | Di et al. | 166/250.02 |
| 2008/0121391 | A1 | 5/2008 | Durham | |
| 2008/0217009 | A1 | 9/2008 | Yang | |
| 2008/0270328 | A1 | 10/2008 | Lafferty | |
| 2009/0145608 | A1 | 6/2009 | Croteau | |
| 2009/0211753 | A1 | 8/2009 | Emtiazian | |
| 2009/0321083 | A1 * | 12/2009 | Schinagl | 166/372 |
| 2010/0101787 | A1 * | 4/2010 | McCoy et al. | 166/250.03 |
| 2010/0101798 | A1 * | 4/2010 | Simpson et al. | 166/313 |
| 2010/0252271 | A1 | 10/2010 | Kelley | |
| 2010/0294506 | A1 | 11/2010 | Rodriguez | |
| 2011/0011576 | A1 * | 1/2011 | Cavender et al. | 166/177.1 |
| 2011/0072975 | A1 | 3/2011 | Aarebrot | |
| 2011/0127031 | A1 | 6/2011 | Zolezzi-Garreton | |
| 2011/0139440 | A1 | 6/2011 | Zolezzi-Garreton | |
| 2011/0139441 | A1 * | 6/2011 | Zolezzi Garreton | 166/249 |
| 2011/0155378 | A1 | 6/2011 | Cabanilla | |
| 2011/0182535 | A1 | 7/2011 | Prieto | |
| 2011/0186302 | A1 | 8/2011 | Coyle | |
| 2011/0209879 | A1 | 9/2011 | Quigley | |
| 2011/0247831 | A1 * | 10/2011 | Smith et al. | 166/372 |
| 2012/0012333 | A1 | 1/2012 | Quigley | |
| 2012/0046866 | A1 * | 2/2012 | Meyer et al. | 702/6 |
| 2012/0084055 | A1 * | 4/2012 | Smithson | 702/166 |
| 2013/0029883 | A1 | 1/2013 | Dismuke | |
| 2013/0071262 | A1 | 3/2013 | Green | |
| 2013/0175030 | A1 * | 7/2013 | Ige et al. | 166/250.15 |
| 2013/0299181 | A1 | 11/2013 | Coyle | |
| 2013/0299182 | A1 | 11/2013 | Coyle | |
| 2013/0319661 | A1 | 12/2013 | Xiao | |
| 2014/0174734 | A1 | 6/2014 | Gill | |
| 2014/0262229 | A1 | 9/2014 | Harris | |
| 2014/0262230 | A1 * | 9/2014 | Harris | 166/249 |
| 2015/0027693 | A1 * | 1/2015 | Edwards et al. | 166/250.03 |

FOREIGN PATENT DOCUMENTS

| | | | |
|---|---|---|---|
| CN | 1321257 | C | 6/2007 |
| CN | 100460626 | C | 2/2009 |
| WO | 2011064375 | A2 | 6/2011 |
| WO | 2011070143 | A2 | 6/2011 |

OTHER PUBLICATIONS

Written Opinion of the International Searching Authority, issued on Jul. 17, 2014, during the prosecution of International Application No. PCT/US2014/026293.

* cited by examiner

ACOUSTIC ARTIFICIAL LIFT SYSTEM FOR GAS PRODUCTION WELL DELIQUIFICATION

TECHNICAL FIELD

The present invention relates to deliquification of gas production wells, and more particularly, to an acoustic artificial lift system and method for deliquification of gas production wells.

BACKGROUND

In subterranean reservoirs that produce gas, liquids (e.g., water) often are present as well. The liquids can come from condensation of hydrocarbon gas (condensate), from bound or free water naturally occurring in the formation (e.g., interstitial and connate water), or from liquids introduced into the formation (e.g., injected fluids). Regardless of the liquid's origin, it is typically desired to transport the liquid to the surface through the production wells via the produced gas. Initially in production, the reservoir typically has sufficient energy and natural forces to drive the gas and liquids into the production well and up to the surface. However, as the reservoir pressure and the differential pressure between the reservoir and the wellbore intake declines overtime due to production, there becomes insufficient natural energy to lift the fluids. The liquids therefore begin to accumulate in the bottom of the gas production wells, which is often referred to as liquid loading.

As the liquids begin to collect in the gas production wells, density separation by gravitational force naturally occurs separating the fluid into a gas column (substantially free of liquid) in the upper portion of the production well, a mixed liquid and gas column (with the percentage of liquid to gas increasing as the well depth increases) in the middle portion of the production well, and a liquid column (substantially free of gas) in the bottom portion of the production well. The liquid column can rise over time if the velocity of the produced gas decreases, thereby reducing the ability of the produced gas to transport the liquid to the surface. In this case, the liquid becomes too "heavy" for the gas to lift such that the liquid coalesces and drops back down the production casing or tubing. As the liquid column rises to a height in the production well where the hydrostatic pressure equals or exceeds the gas formation face pressure, the liquid detrimentally suppresses the rate at which the well fluid is produced from the formation and eventually obstructs gas production completely. Accordingly, this liquid needs to be artificially reduced or removed to ensure proper flow of natural gas (and liquids) to the surface.

There are several conventional methods for deliquification of a gas well such as by direct pumping (e.g., sucker rod pumps, electrical submersible pumps, progressive cavity pumps). Another common method is to run a reduced diameter (e.g., 0.25 to 1.5 inches) velocity or siphon string into the production well. The velocity or siphon string is used to reduce the production flow area, thereby increasing gas flow velocity through the string and attempting to carry some of the liquids to the surface as well. Another alternative method is the use of plunger lift systems, where small amounts of accumulated fluid is intermittently pushed to the surface by a plunger that is dropped down the production string and rises back to the top of the wellhead as the well shutoff valve is cyclically closed and opened, respectively. Another method is gas lift, in which gas is injected downhole to displace the well fluid in production tubing string such that the hydrostatic pressure is reduced and gas is able to resume flowing. Additional deliquification methods previously implemented include adding wellhead compression and injection of soap sticks or foamers.

Although there are several conventional methods for removing liquids from a well, few, if any, of the current commercially available methods provide sufficient means for removal of liquid from natural gas wells with low bottom-hole pressure. In addition, some of the above described methods may be cost prohibitive in times where the market value of gas is relatively low or for low production gas wells (i.e., marginal or stripper wells).

SUMMARY

An acoustic artificial lift system and method for deliquification of gas production wells is disclosed.

In embodiments, a wellbore that receives reservoir fluids, including gas, from a producing zone of a subterranean reservoir is provided. An acoustic wave is generated from an acoustic tool and the acoustic tool is moved within the wellbore such that liquid molecules within the wellbore are vaporized by the acoustic wave and transported to a well surface by the gas received from the producing zone of the subterranean reservoir.

In embodiments, the acoustic artificial lift system comprises an acoustic tool, a conductive cable, a winch, and a control panel. The conductive cable is connected at a first end to the acoustic tool and at a second end to the winch. The control panel controls movement of the acoustic tool within a wellbore using the winch such that liquid molecules within the wellbore are vaporized by an acoustic wave generated from the acoustic tool.

In embodiments, the acoustic wave generated by the acoustic tool has a frequency of greater than or equal to 10 kHz, 100 kHz, 500 kHz, or 1 MHz.

In embodiments, the acoustic wave comprises an ultrasonic emitter having one or more quartz crystals that generate the acoustic wave, a power unit that controls the electrical energy level applied to the one or more quartz crystals, and a location detection device that is used to determine a depth for which the acoustic tool is positioned within the wellbore.

DETAILED DESCRIPTION

Embodiments of the present invention relate to an acoustic artificial lift system and method for deliquification of gas production wells, thereby supporting natural gas production. As will be described, the acoustic artificial lift system includes a down-hole acoustic tool suspended by a power conductive cable and winch system. The down-hole tool is systematically lowered into the production well and generates acoustic energy to vaporize liquids such that they can be transported to the surface by the produced gas. The acoustic artificial lift system is relatively straightforward to deploy, requires a relatively small surface footprint, does not inflict damage on the wellbore, production equipment or reservoir formation, is environmentally friendly, and may reduce operational costs related to rig expense and safety. Moreover, because the acoustic artificial lift system in not predominantly a mechanical system, it can enhance the range of natural gas production and extend the life of a producing well.

Figure 1:
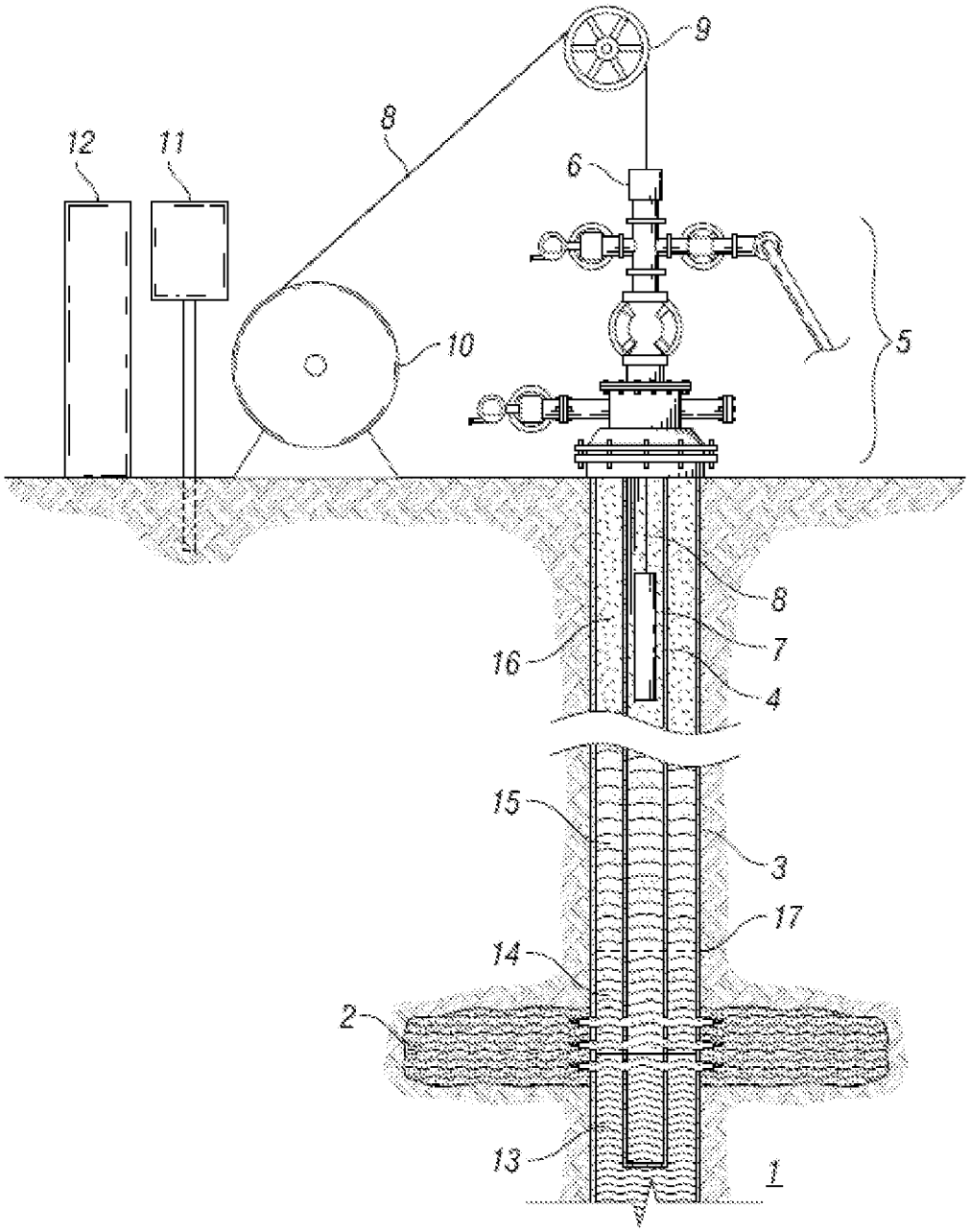
FIGS. 1-4 are schematics of an acoustic artificial lift system, illustrating deliquification of a gas production well having production tubing.

FIG. 1 is a schematic of an acoustic artificial lift system used for deliquification of gas production wells. As illustrated in FIG. 1, a production well is drilled and completed in subterranean reservoir 1. Production well can deviate from the vertical position such that in some embodiments, production well can be a directional well, horizontal well, or a multilateral well. Furthermore, production well can be completed in any manner (e.g., a barefoot completion, an openhole completion, a liner completion, a perforated casing, a cased hole completion, a conventional completion). Subterranean reservoir 1 includes a plurality of rock layers including hydrocarbon bearing strata or zone 2. The production well extends into hydrocarbon bearing zone 2 of subterranean reservoir 1 such that the production well is in fluid communication with hydrocarbon bearing zone 2 and can receive fluids (e.g., gas, oil, water) therefrom. Subterranean reservoir 1 can be any type of subsurface formation in which hydrocarbons are stored, such as limestone, dolomite, oil shale, sandstone, or a combination thereof. While not shown in FIG. 1 and readily appreciated by those skilled in the art, additional injection wells and/or production wells can also extend into hydrocarbon bearing zone 2 of subterranean reservoir 1.

The production well shown in FIG. 1 includes an outer production casing 3 that is cemented or set to the well depth (e.g., plugged back total depth, completed depth, or total depth). After the production well is completed, production string or tubing 4 is inserted into the well to assist with producing fluids from the hydrocarbon bearing zone 2 of subterranean reservoir 1. Typically production casing 3 and production string 4 are connected to or hung from wellhead 5, which is positioned on the surface (i.e., ground surface or platform surface in the event of an offshore production well). Wellhead 5 additionally provides access and control to production casing 3 and production string 4. Wellhead 5 also includes what is commonly known in the petroleum industry as a Christmas tree (i.e., an assembly of valves, chokes, spools, fittings, and gauges used to direct and control produced fluids), which can be of any size or configuration (e.g., low-pressure or high-pressure, single-completion or multiple-completion). Stuffing Box or Lubricator 6 is positioned on top of, and connected to, wellhead 5. Lubricator 6 is used to provide lubrication for any cables (e.g., wireline or electric line) run in a completed well. Lubricator 6 also provides a seal to prevent tubing leaks or "blowouts" of produced fluids from hydrocarbon bearing zone 2 of subterranean reservoir 1.

Acoustic tool 7 is also shown in FIG. 1. As shown in FIG. 1, acoustic tool is cylindrical in shape; however, acoustic tool 7 can be any shape or size as long it can fit and move within a wellbore. Acoustic tool 7 is suspended by a power conductive cable 8 via pulley 9 (that can be supported by an adjustable crane arm, stationary support system, or by any other means) and winch 10. Lubricator 6 lubricates conductive cable 8 as it is positioned within production tubing 4. Lubricator 6 also provides a seal with power conductive cable 8 to prevent escape of produced fluids from hydrocarbon bearing zone 2 of subterranean reservoir 1. Acoustic tool 7 includes an ultrasonic emitter, a power unit, and a location detection device. In embodiments, the ultrasonic emitter comprises a piezo crystal tranducer, which includes one or more quartz crystals (i.e., piezoelectric crystals). When electric current is applied to the one or more quartz crystals, the piezo crystal transducer generates acoustic waves that radiate outwardly from acoustic tool 7 within production tubing 4. The power unit of acoustic tool 7 can control and modulate the electrical energy level applied to the one or more quartz crystals. The power unit of acoustic tool 7 can include a power receiver, power converter, power attenuator, and any other power equipment needed to apply a sufficient amount of electrical current to the one or more quartz crystals such that the piezo crystal transducer generates acoustic waves in the ultrasonic spectrum of kilo hertz (kHz) or mega hertz (MHz). In one example, the piezo crystal transducer generates acoustic waves with frequencies of 10 kHz to 10 MHz. The location detection device of acoustic tool 7 is utilized to determine the depth for which acoustic tool 7 is positioned within production tubing 4. The location detection device includes data acquisition instrumentation (DAI), which transmits and receives a signal (e.g., an acoustic signal) that can be used to determine a distance from the surface of liquid column within the production well or a distance from a transition point to a predefined ratio of liquid to gas within the production well (i.e., a particular fluid density in mixed liquid and gas column). In embodiments, the transition point has a gas to liquid ratio of greater than or equal to 1000. In other embodiments, the transition point has a gas to liquid ratio of greater than or equal to 5000. The location detection device can transmit a signal and capture the interval transit time for the signal to be echoed off the surface of liquid column or the transition point of a particular fluid density. The interval transit time can then be used to compute the distance between acoustic tool 7 and the surface of liquid column or the transition point of a particular fluid density within the production well.

The distance between acoustic tool 7 and the surface of liquid column or the transition point of a particular fluid density can be computed by the location detection device of acoustic tool 7. Alternatively, acoustic tool 7 can transmit the interval transit time through conductive cable 8 to control panel 11 for computing the distance between acoustic tool 7 and the liquid column or the transition point of a particular fluid density within the production well. In either case, control panel 11 receives either the computed distance or interval transit time from acoustic tool 7, and determines the proper depth for which acoustic tool 7 should be positioned within production tubing 4. Control panel 11 can position acoustic tool 7, via controlling winch 10, based on a variety of parameters such as the depth of acoustic tool and the depth of liquid column's surface (or a distance therebetween), well temperature, well pressure, winch position, and winch speed. Control panel 11 is an intelligent interface, often integrated with supervisory control and data acquisition (SCADA) ability, that processes the signals from acoustic tool 7, winch 10, and power unit 12. Control panel 11 can also activate (i.e., turn on), deactivate (i.e., turn off), and control the intensity of the acoustic waves generated by acoustic tool 7. Variable speed drive (VSD), also called adjustable speed drive (ASD) and variable frequency drive (VFD), can be utilized by control panel 11 to control components of acoustic artificial lift system. Control panel 11 is powered via power source 12. Power source 12 can comprise any means to supply power to acoustic tool 7, winch 10, control panel 11, and other well field equipment (e.g., sensors, data storage devices, communication networks).

In operation, acoustic artificial lift system is lowered into production string 4 to reduce, remove, or prevent the accumulation of liquid at the bottom of the production well, thereby allowing for unhindered flow of natural gas (and liquids) to the surface. As previously described, if liquid loading has occurred, the liquids naturally separate into liquid column 13, a transition column of mixed liquid and gas, and gas column 16. As illustrated in FIG. 1, the percentage of liquid to gas within the transition column increases as the well depth increases. In particular, dashed line 17 represents a transition point such that below dashed line 17 the density of fluid is heavier (mixed liquid and gas column 14) and above dashed line 17 the density of fluid is lighter (mixed gas and liquid column 15).

Figure 2:
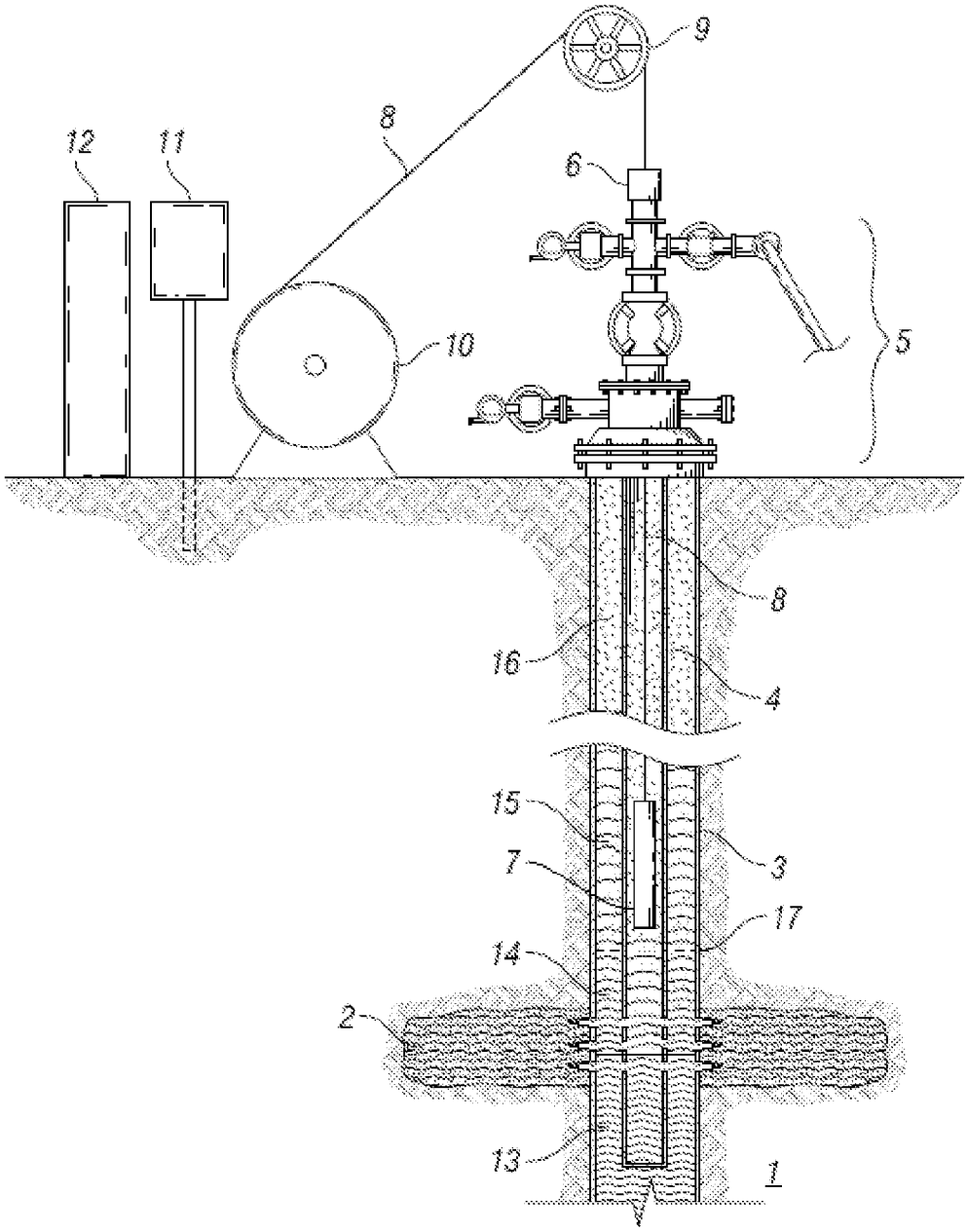

As acoustic tool 7 is lowered into production tubing 4 (FIG. 2), acoustic tool 7 is activated such that it generates the frequency needed for gas to lift liquid droplets to the surface. In particular, acoustic energy generated by acoustic tool 7 vibrates the liquid molecules at a frequency (e.g., >10 kHz) so that the surface tension of the liquid droplets shear and collapse into smaller droplets. Eventually the frequency causes the liquid (e.g., water) to "vaporize" (i.e., atomize or cavitate) such that it can then be transported to the surface by the natural gas velocity in the well. Once on the surface the water can be separated from the natural gas according to processes well known in the art. As the level of the liquid in mixed liquid and gas column 14, 15 decrease, control panel 11 recalculates and repositions the acoustic tool 7. In one embodiment, control panel 11 calculates the distance between acoustic tool 7 and the liquid interface of liquid and gas column 14 and automatically adjusts (i.e., raises or lowers) acoustic tool 7 to be positioned proximate (i.e., at or just above) the liquid interface of liquid and gas column 14 (i.e., dashed line 17). In another embodiment, control panel 11 calculates the distance between acoustic tool 7 and the liquid interface of liquid column 13 and automatically adjusts (i.e., raises or lowers) acoustic tool 7 to be positioned proximate (i.e., at or just above) the liquid interface of liquid column 13. During operation, acoustic tool 7 is not submersed in accumulated liquid (i.e., positioned below the liquid interface of liquid column 13), as liquids would absorb the acoustic energy generated by acoustic tool 7 rendering acoustic tool 7 ineffective.

Figure 3:
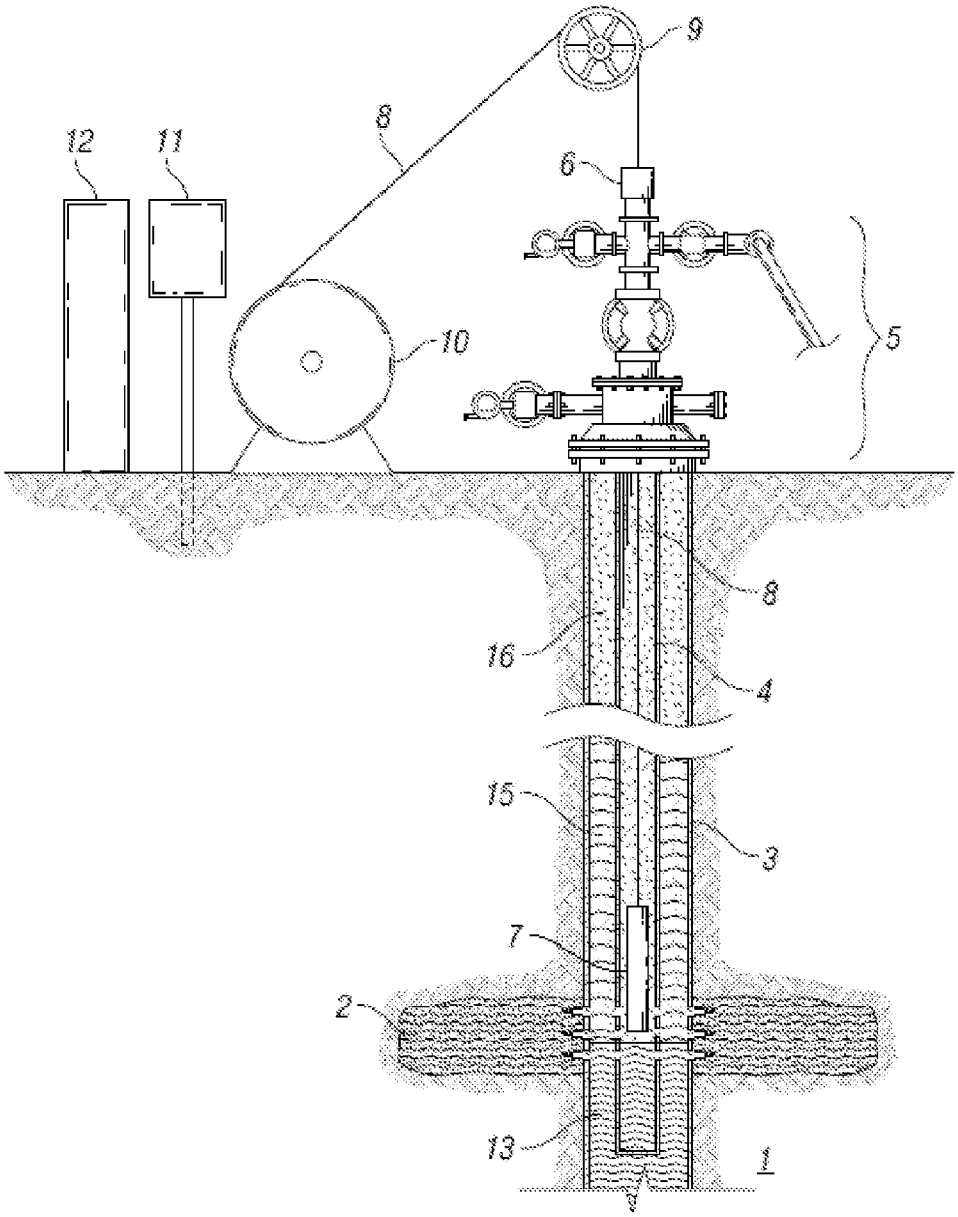
Figure 4:
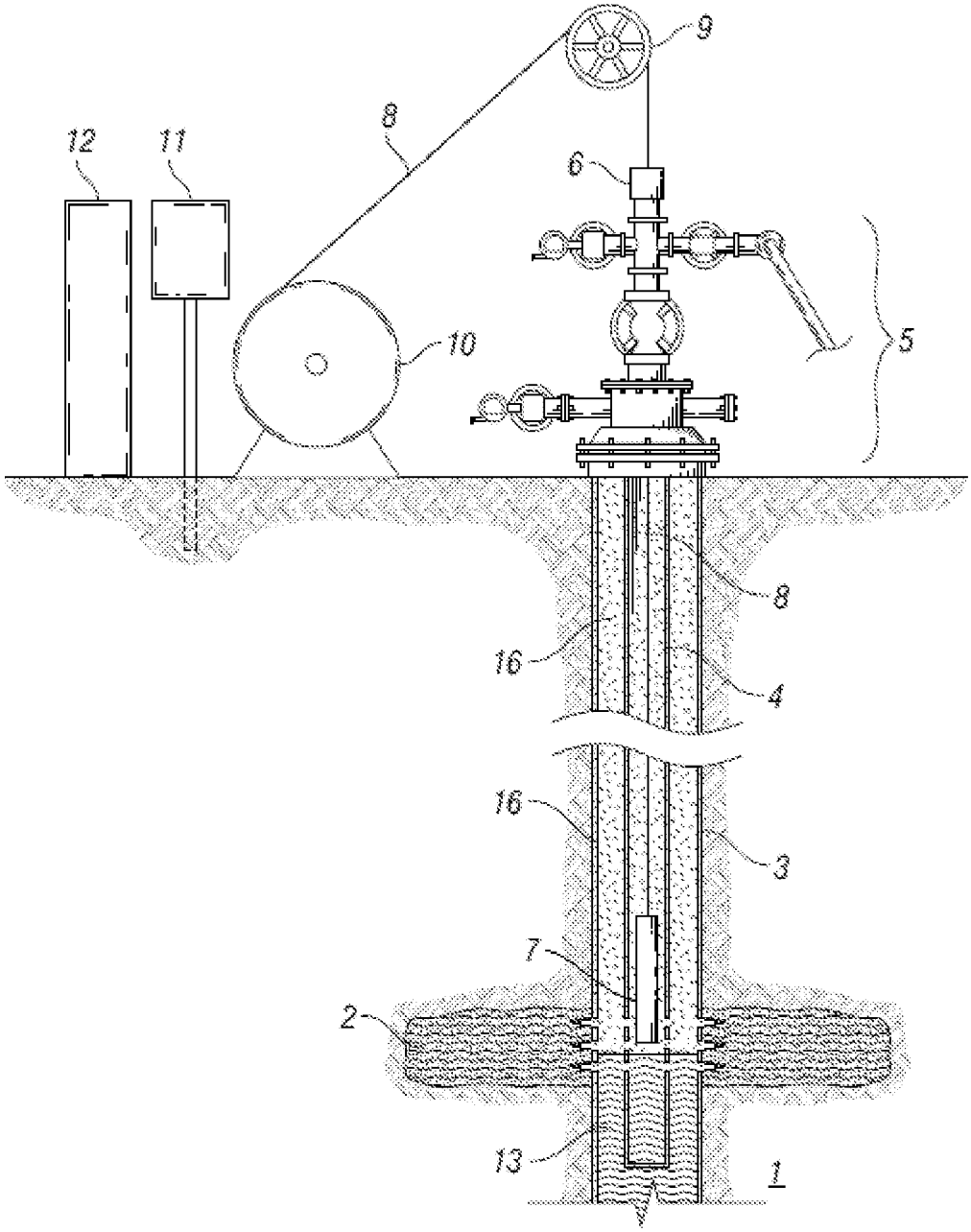
Figure 5:
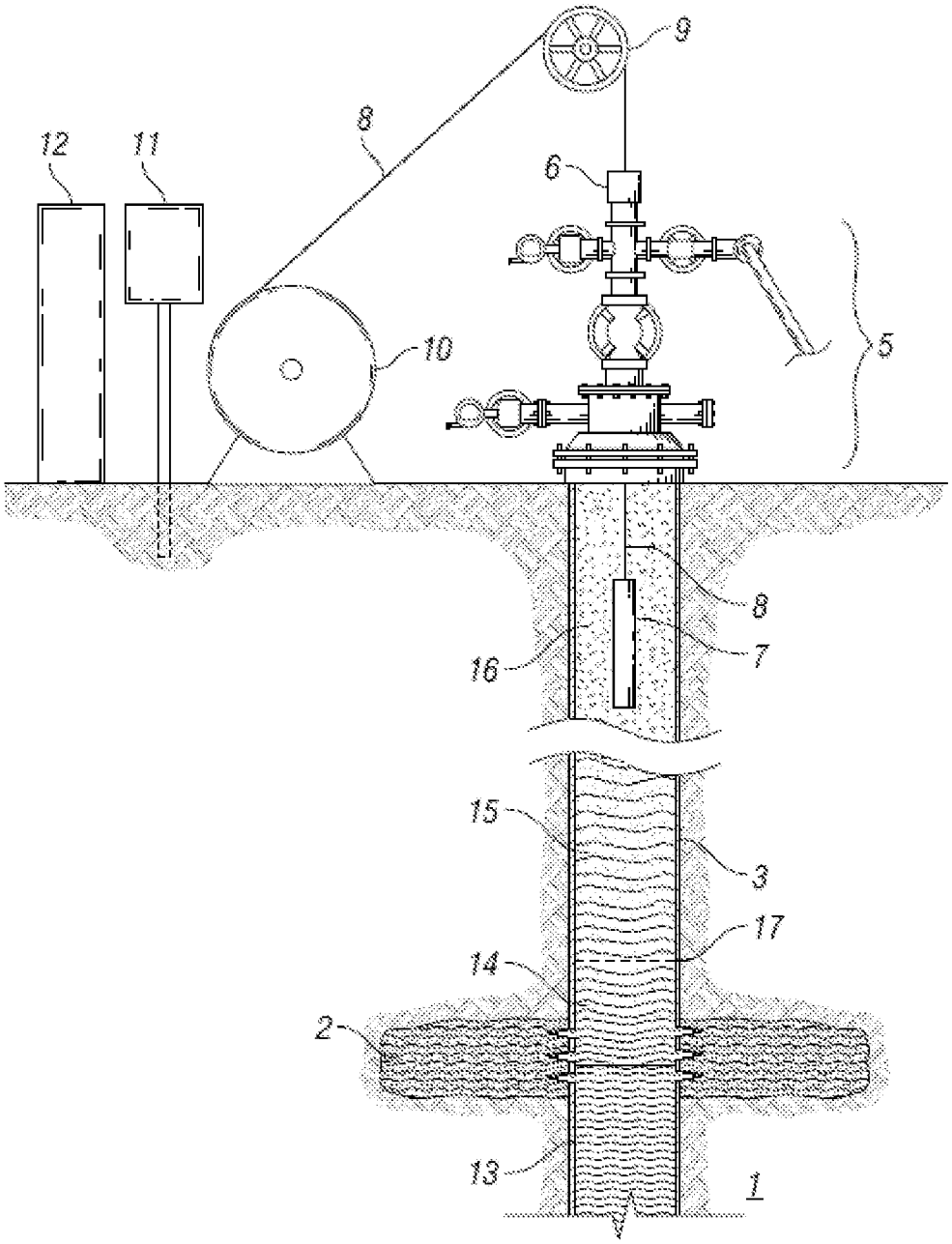
FIGS. 5-8 are schematics of an acoustic artificial lift system, illustrating deliquification of a gas production well without production tubing.

FIGS. 1-4 illustrate the deliquification process of a gas production well having production tubing 4. Here, production occurs through production tubing 4 and the gas composition increases in the production casing 3 by the removal of liquid via production tubing 4. If the production well is "dead" (i.e., no gas flow exists due to hydrostatic liquid column pressure), then the production well typically needs to be swabbed via production tubing 4. After swabbing, liquids in the production well naturally separate into liquid column 13, a transition column of mixed liquid and gas 14,15, and gas column 16. As acoustic tool 7 is lowered (FIG. 2), acoustic tool 7 enters into mixed liquid and gas column 15 (i.e., gas dominant portion of mixed liquid and gas column). Within production tubing 4, acoustic tool 7 atomizes the liquid composition so that the liquid is removed by the gas velocity. Accordingly, mixed gas and liquid column 15 transitions to gas column 16 within production tubing 4 as acoustic tool 7 is lowered. This reduction in liquid head pressure results in gas expansion in mixed liquid and gas column 14 while reducing the liquid composition. The emitter tool is systematically lowered into production well (according to control panel 11) and continues to atomize the liquid with the expanding gas velocity carrying the atomized liquid up the tubing to the surface. The process continues until the emitter tool is lowered to point where the inflow rate from hydrocarbon bearing zone 2 of subterranean reservoir 1 is substantially equivalent to the production rate through production tubing 4 (FIG. 3). Additionally, while acoustic tool 7 is operated in production tubing 4, gas column 16 is produced up production casing 3 (FIG. 4). Gas column 16 will continue to expand as the hydrostatic pressure from the liquid components in production casing 3 is reduced.

Figure 6:
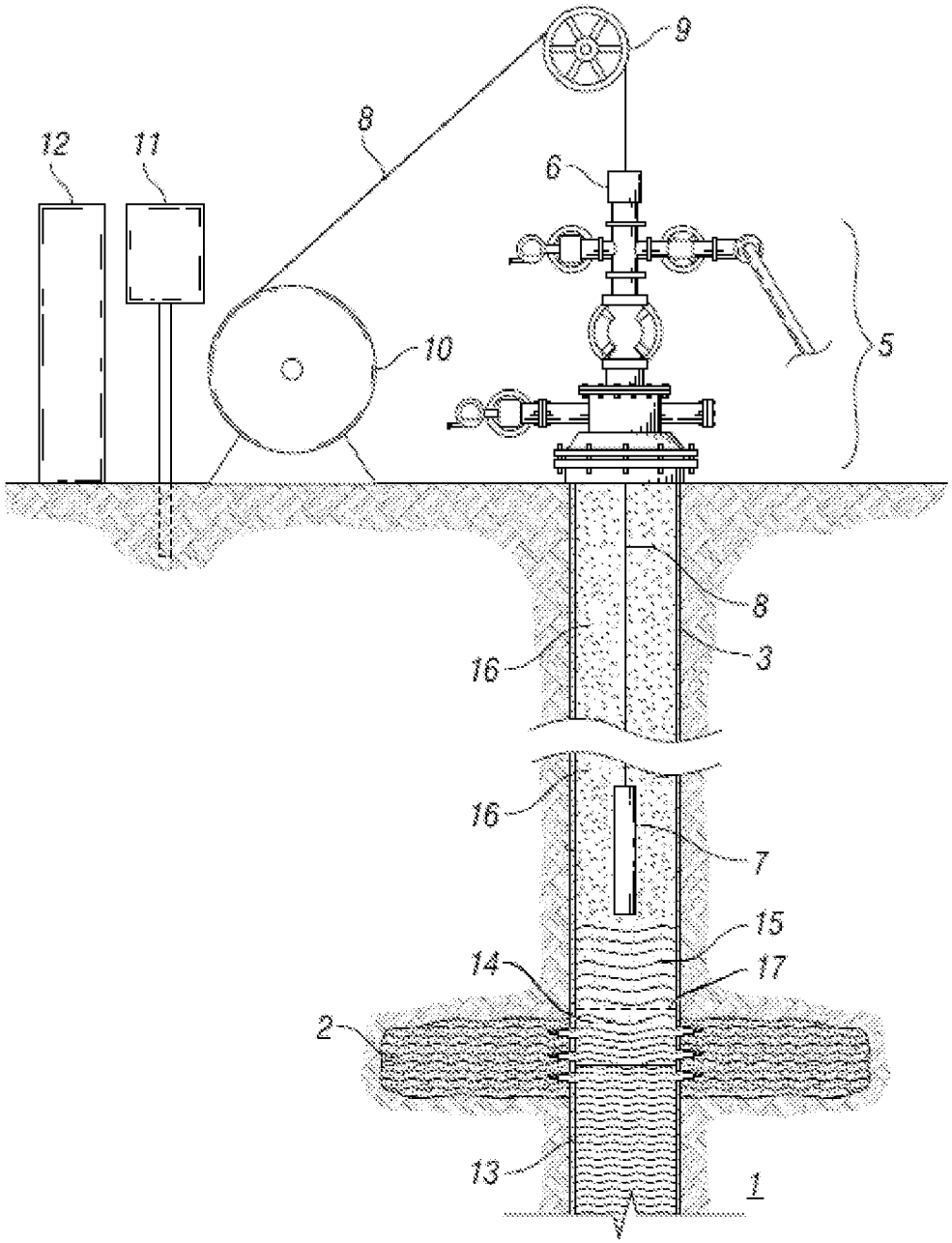
Figure 7:
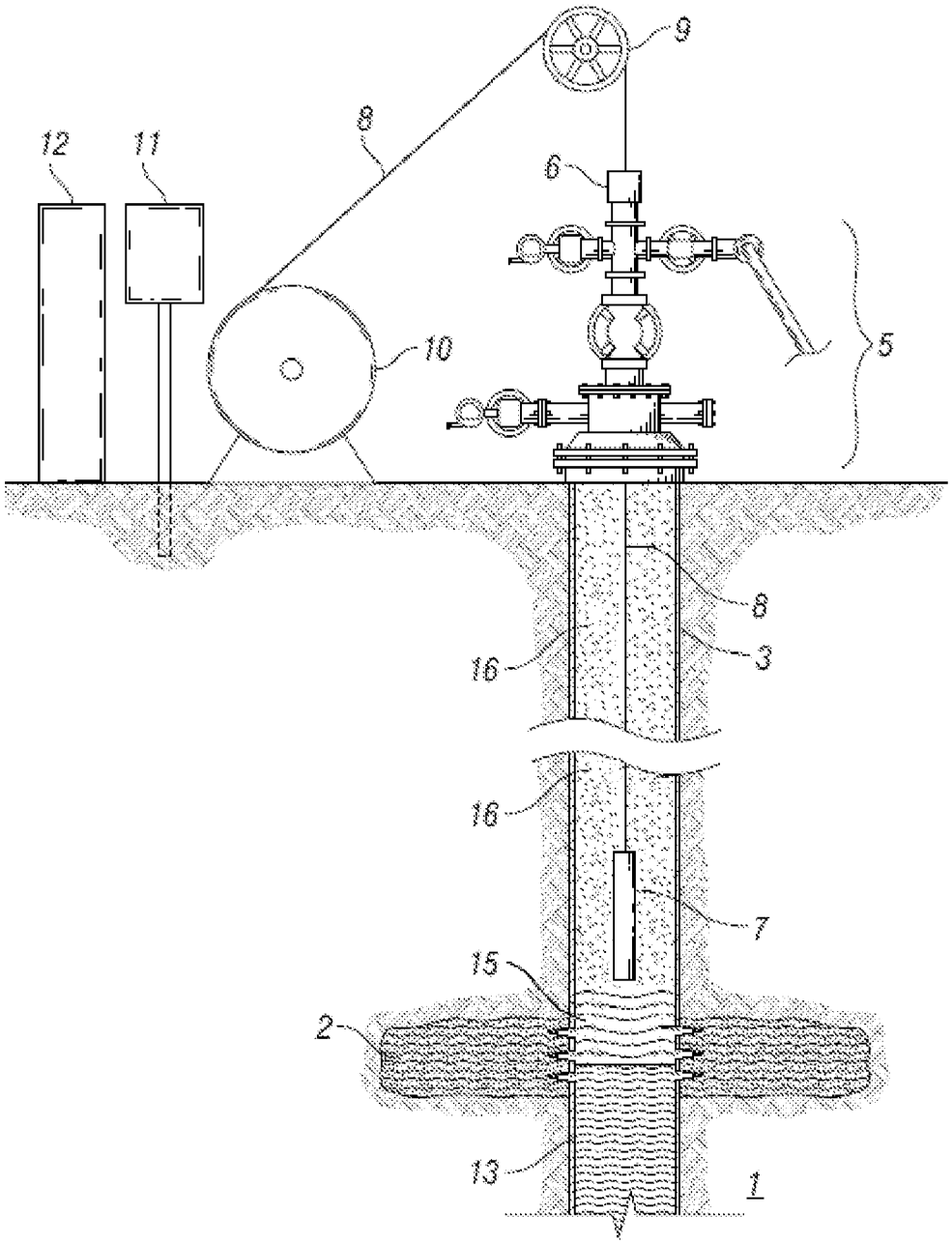
Figure 8:
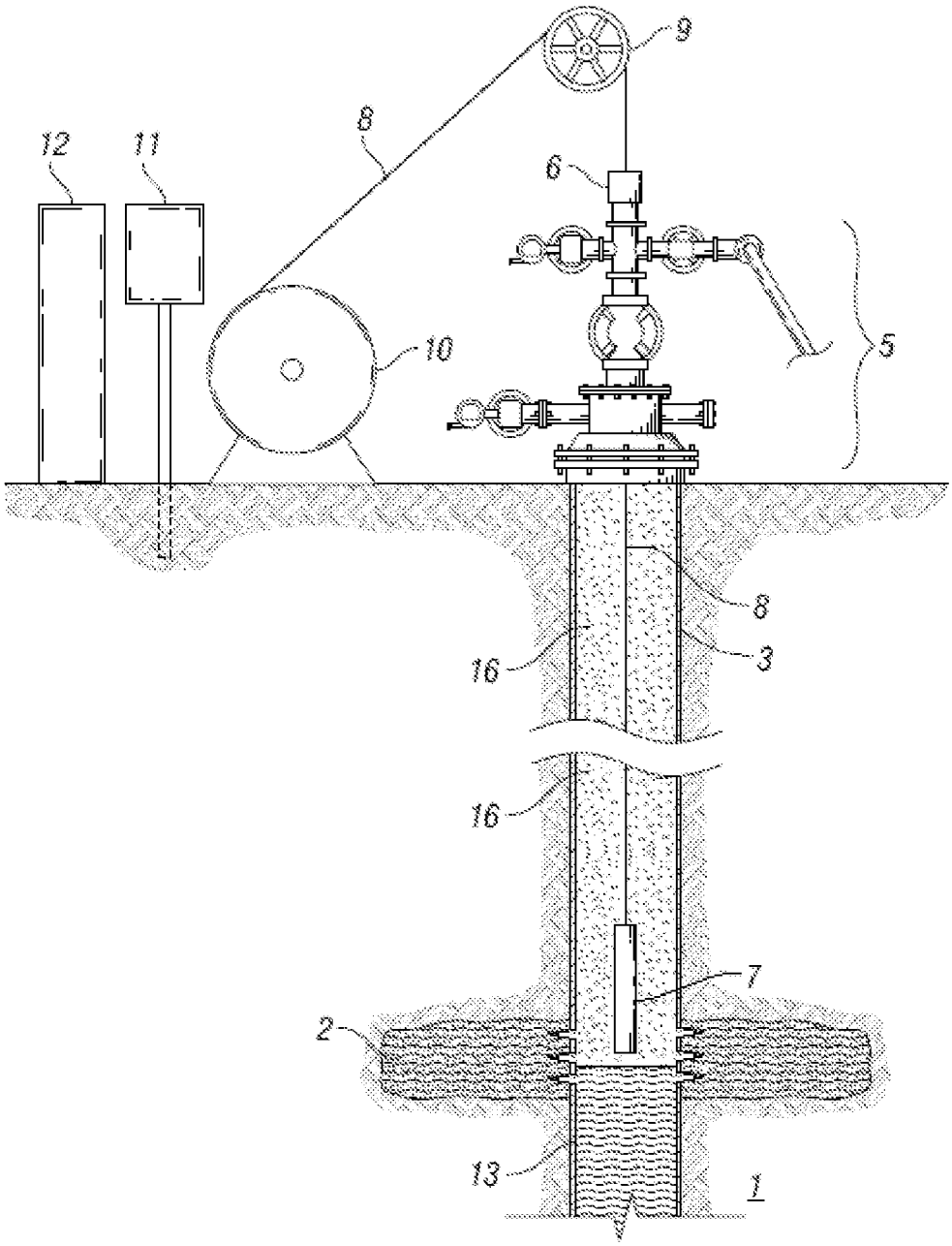

FIGS. 5-8 illustrate deliquification of a gas production well having a cased hole completion (i.e., without production tubing). As acoustic tool 7 is lowered into production casing 3 (FIG. 5), acoustic tool 7 is activated such that it generates the frequency needed for gas to lift liquid droplets to the surface. Similar to FIGS. 1-4, as the level of the liquid in mixed liquid and gas column 14, 15 decreases, control panel 11 recalculates and repositions acoustic tool 7. For example, as shown in FIGS. 6-8, gas and liquid column 15 becomes diminished and transitions into gas column 16. Furthermore, liquid and gas column 14 becomes diminished and transitions from a liquid dominate composition to a gas dominant composition (i.e., transitions into gas and liquid column 15). The decreased head pressure eventually results in removal of both gas and liquid column 15 and liquid and gas column 14 (FIG. 8). In particular, reservoir pressure and the relative water and gas permeabilities in hydrocarbon bearing zone 2 of subterranean reservoir 1 result in increased fluid flow into production casing 3 via the perforations until an equilibrium or stable production level is achieved. At this point, the inflow of liquids into production casing 3 is countered by the removal of liquids atomized by the acoustic tool 7 and carried up production casing 3 by the gas velocity.

As shown in FIGS. 1-8, acoustic tool 7 has little impact on liquid column 13. However, if the gas relative permeability increases sufficiently in hydrocarbon bearing zone 2 of subterranean reservoir 1, then it may become possible to lower acoustic tool 7 until liquid column is reduced and acoustic tool 7 can be placed at the formation face or adjacent the production well perforations.

Figure 9:
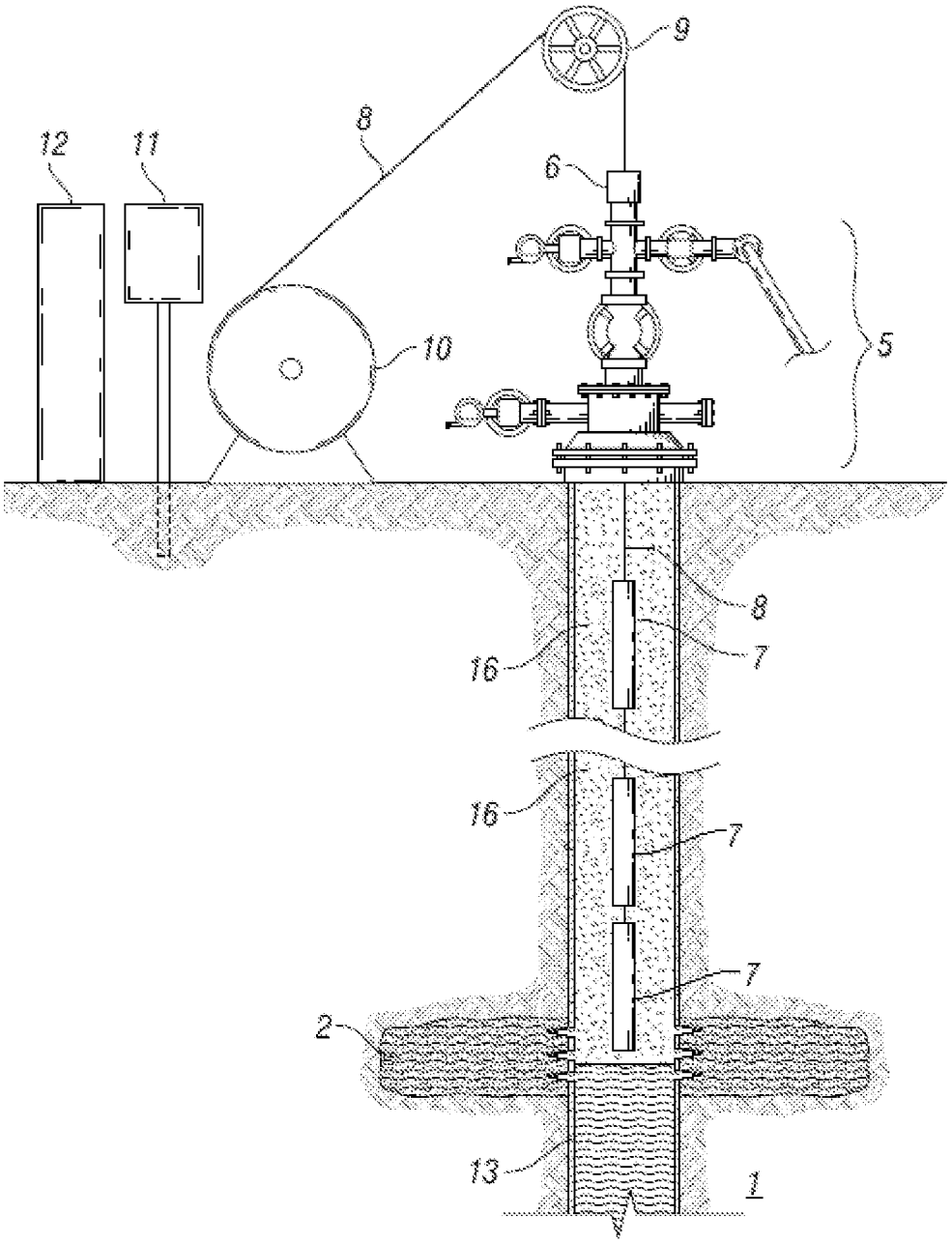
FIG. 9 is a schematic of an acoustic artificial lift system having multiple acoustic emitters used for deliquification of gas production wells.

FIG. 9 is a schematic of an acoustic artificial lift system having multiple acoustic tools 7 positioned within production casing 3. In this embodiment, each acoustic tool can generate the same or various levels of acoustic energy. The number of acoustic tools 7 can be dependent on well depth, but reduce the likelihood of the liquid coalescing and dropping back down the production casing 3. Additionally, multiple acoustic tools 7 can provide redundancy in the event that one of the acoustic tools 7 fails and can accelerate deliquification of the production well. While FIG. 9 shows a cased hole completion, one skilled in the art will recognize multiple acoustic tools 7 can be utilized in other completion types (e.g., completions including production tubing).

As used in this specification and the following claims, the terms "comprise" (as well as forms, derivatives, or variations thereof, such as "comprising" and "comprises") and "include" (as well as forms, derivatives, or variations thereof, such as "including" and "includes") are inclusive (i.e., open-ended) and do not exclude additional elements or steps. Accordingly, these terms are intended to not only cover the recited element(s) or step(s), but may also include other elements or steps not expressly recited. Furthermore, as used herein, the use of the terms "a" or "an" when used in conjunction with an element may mean "one," but it is also consistent with the meaning of "one or more," "at least one," and "one or more than one." Therefore, an element preceded by "a" or "an" does not, without more constraints, preclude the existence of additional identical elements.

The use of the term "about" applies to all numeric values, whether or not explicitly indicated. This term generally refers to a range of numbers that one of ordinary skill in the art would consider as a reasonable amount of deviation to the recited numeric values (i.e., having the equivalent function or result). For example, this term can be construed as including a deviation of ±10 percent of the given numeric value provided such a deviation does not alter the end function or result of the value. Therefore, a value of about 1% can be construed to be a range from 0.9% to 1.1%.

While in the foregoing specification this invention has been described in relation to certain preferred embodiments thereof, and many details have been set forth for the purpose of illustration, it will be apparent to those skilled in the art that the invention is susceptible to alteration and that certain other details described herein can vary considerably without departing from the basic principles of the invention. For example, while embodiments of the present disclosure are described with reference to operational illustrations of methods and systems, the functions/acts described in the figures may occur out of the order (i.e., two acts shown in succession may in fact be executed substantially concurrently or executed in the reverse order). In addition, the above-described system and method can be combined with other artificial lift techniques (e.g., velocity or siphon strings, gas lift, wellhead compression, injection of soap sticks or foamers).

What is claimed is:

1. A method for deliquification of production wells, the method comprising:

(a) providing a wellbore that receives reservoir fluids from a producing zone of a subterranean reservoir, the reservoir fluids comprising gas;

(b) providing an acoustic tool within the wellbore, wherein the acoustic tool comprises:

(i) an ultrasonic emitter comprising a piezo crystal transducer having one or more piezoelectric crystals that generate an acoustic wave and (ii) a power unit that controls an electrical energy level applied to the one or more piezoelectric crystals;

(c) generating the acoustic wave with the acoustic tool, wherein the acoustic wave generated by the acoustic tool has a frequency in an ultrasonic spectrum;

(d) vaporizing liquid molecules within the wellbore through vibration of the liquid molecules by the acoustic wave emitted by the acoustic tool; and (e) transporting the vaporized liquid molecules up to a well surface by the gas received in the wellbore from the producing zone of the subterranean reservoir.

2. The method of claim 1, further comprising moving the acoustic tool within the wellbore, and wherein moving the acoustic tool within the wellbore further comprises:

computing a distance between the acoustic tool and a transition point in a mixed liquid and gas column in the wellbore, and positioning the acoustic tool relative to the transition point.

3. The method of claim 2, wherein the transition point has a gas to liquid ratio of greater than or equal to 1000.

4. The method of claim 1, further comprising moving the acoustic tool within the wellbore, and wherein moving the acoustic tool within the wellbore further comprises:

computing a distance between the acoustic tool and a liquid column interface in the wellbore, and positioning the acoustic tool relative to the liquid column interface.

5. The method of claim 1, wherein a plurality of acoustic tools are moved along the wellbore.

6. The method of claim 1, wherein the frequency of the acoustic wave generated by the acoustic tool is greater than 10 kHz.

7. The method of claim 1, wherein the frequency of the acoustic wave generated by the acoustic tool is greater than or equal to 100 kHz.

8. The method of claim 1, wherein the frequency of the acoustic wave generated by the acoustic tool is greater than or equal to 500 kHz.

9. The method of claim 1, wherein the frequency of the acoustic wave generated by the acoustic tool is greater than or equal to 1 MHz.

10. The method of claim 1, wherein the acoustic tool further comprises a location detection device that is used to determine a depth for which the acoustic tool is positioned within the wellbore.

11. An acoustic artificial lift system for deliquification of gas production wells, the system comprising:

(a) an acoustic tool that is provided within a wellbore that receives reservoir fluids from a producing zone of a subterranean reservoir, wherein the reservoir fluids comprise gas, wherein the acoustic tool comprises:

(i) an ultrasonic emitter comprising a piezo crystal transducer having one or more piezoelectric crystals that generate an acoustic wave and (ii) a power unit that controls an electrical energy level applied to the one or more piezoelectric crystals;

(b) a conductive cable that is connected at a first end to the acoustic tool;

(c) a winch that is connected to a second end of the conductive cable; and (d) a control panel that controls movement of the acoustic tool within the wellbore using the winch such that the acoustic wave is generated with the acoustic tool with a frequency in an ultrasonic spectrum, liquid molecules from the wellbore are vaporized through vibration of the liquid molecules by the acoustic wave emitted by the acoustic tool, and the vaporized liquid molecules are transported to a well surface by the gas received in the wellbore from the producing zone of the subterranean reservoir.

12. The acoustic artificial lift system of claim 11, wherein the acoustic tool comprises:

a location detection device that is used to determine a depth for which the acoustic tool is positioned within the wellbore.

13. The acoustic artificial lift system of claim 11, wherein a plurality of acoustic tools are disposed within the wellbore to generate acoustic waves, thereby vaporizing liquid molecules within the acoustic tools.

14. The acoustic artificial lift system of claim 11, wherein the control panel further computes a distance between the acoustic tool and a transition point in a mixed liquid and gas column in the wellbore, and positions the acoustic tool relative to the transition point.

15. The acoustic artificial lift system of claim 14, wherein the transition point has a gas to liquid ratio of greater than or equal to 1000.

16. The acoustic artificial lift system of claim 11, wherein the control panel further computes a distance between the acoustic tool and a liquid column interface in the wellbore, and positions the acoustic tool relative to the liquid column interface.

17. The acoustic artificial lift system of claim 11, wherein the frequency of the acoustic wave generated by the acoustic tool is greater than 10 kHz.

18. The acoustic artificial lift system of claim 11, wherein the frequency of the acoustic wave generated by the acoustic tool is greater than or equal to 100 kHz.

19. The acoustic artificial lift system of claim 11, wherein the frequency of the acoustic wave generated by the acoustic tool is greater than or equal to 500 kHz.

20. The acoustic artificial lift system of claim 11, wherein the frequency of the acoustic wave generated by the acoustic tool is greater than or equal to 1 MHz.

* * * * *